US005478280A

United States Patent [19]

Denham

[11] Patent Number: 5,478,280

[45] Date of Patent: Dec. 26, 1995

[54] METHOD OF MAKING A TUBULAR BODY HAVING A DEFORMABLE INTERNAL SKIRT

[75] Inventor: Keith Denham, Welwyn Garden City, England

[73] Assignee: Avdel Systems Limited, Welwyn Garden City, England

[21] Appl. No.: 124,000

[22] Filed: Sep. 21, 1993

[30] Foreign Application Priority Data

Sep. 22, 1992 [GB] United Kingdom ..... 9220042

[51] Int. Cl.[6] ..... B21K 1/58

[52] U.S. Cl. ..... 470/29; 72/338

[58] Field of Search ..... 72/338, 339, 367, 72/370; 470/29, 40; 29/DIG. 41

[56] References Cited

U.S. PATENT DOCUMENTS

| | | | |
|---|---|---|---|
| 1,877,342 | 9/1932 | Malby | 72/367 |
| 2,361,771 | 10/1944 | Huck | 470/29 |
| 2,395,721 | 2/1946 | Buchet | 470/29 |
| 3,166,769 | 1/1965 | Wieber | 470/29 |
| 4,473,914 | 10/1984 | Haft . | |
| 4,639,174 | 1/1987 | Denham et al. | 411/34 |
| 5,248,231 | 9/1993 | Denham et al. | 411/43 |
| 5,252,013 | 10/1993 | Browne et al. | 411/43 |

*Primary Examiner*—Lowell A. Larson
*Assistant Examiner*—Thomas C. Schoeffler
*Attorney, Agent, or Firm*—Olbon, Spivak, McClelland, Maier & Neustadt

[57] ABSTRACT

A tubular body (74, 102) having a deformable internal annular skirt is made from a blank (10, 80) having a stopped bore (20) which terminates at an end wall (24). First, an aperture (40) is formed in the end wall (24) to provided a through bore, of which a main region is provided by the formerly stopped bore (20). The aperture (40) is made to taper towards the main region and to a diameter substantially smaller than that of the main region. Material peripherally of the aperture (40) is then swaged towards and into the main region, and radially outwardly in the main region, thereby forming the swaged material into a skirt. The tapering aperture (40) can be formed by use of a punch (30) and a die (32) having a die aperture (36) larger than the punch diameter. By making the aperture (40) not radially symmetrical, the resulting skirt (70, 98) can be made of unequal lengths on opposite radii. The aperture (114) can be made non-symmetrical by using a punch slightly offset from the axis of the die aperture (36) or by making the end wall of different thickness on different radii.

8 Claims, 5 Drawing Sheets

METHOD OF MAKING A TUBULAR BODY HAVING A DEFORMABLE INTERNAL SKIRT

This invention relates to a method of making a tubular body having a deformable internal skirt, more particularly, although not exclusively, a tubular body suitable for a self-plugging blind fastener, or the like, in which the internal skirt is deformable into locking engagement with a plug which is to be retained in the bore of the body.

Self-plugging blind fasteners are well known, and generally comprise a tubular body of metal having an elongate shank and a head at one end, and an elongate stem, usually also of metal, which, in order to set the fastener, is pulled into or along the bore of the body, so as to cause a radial expansion of the shank, at least part of the stem being positively locked in the body of the set fastener so that the part is retained as a plug within the bore.

More particularly, in some examples of blind fastener, such as those described in British patent No. 2 127 514 and our co-pending British patent application No. 92 17806.0, the stem has an annular locking recess and a shoulder adjacent to the recess, and the body has a through bore having a main region and a region of reduced diameter which provides a shoulder, the shoulder having a face which faces into the main region, and an annular cleavage, coaxial with the bore, extends from the main region into the shoulder. The cleavage radially separates material of the shoulder from surrounding material of the body, and thus provides an internal annular skirt peripherally of the reduced diameter region of the bore which, in use of the fastener, is engaged by the shoulder of the stem, and deformed into the locking recess to lock the stem in the body.

A known method of making a body (which is sometimes called a "sleeve") for such a fastener is described in U.S. Pat. No. 4,473,914.

The known method comprises the steps of forming a blank having a head end and a tail end, and a stopped bore extending from the tail end towards the head end and terminating at an end wall adjacent to the head end of the blank, piercing through the end wall to provide a through bore of which a main region is provided by the formerly stopped bore, and a region formed by the piercing step has a diameter which is reduced as compared with the diameter of the main region, the region of reduced diameter defining a stop shoulder peripherally of the reduced region, the stop shoulder presenting a stop face which faces into the main region and towards the tail end, then deforming material of the shoulder to move the material in a direction axially towards the head end and radially inwardly into the region of reduced diameter, and thereby extending the main region of the bore towards the head end, and then deforming that material away from the head end and radially outwardly into the main region of the bore to reform a shoulder at the junction between the main region and the region of reduced diameter, with the shoulder now being radially separated by a cleavage from material of the body peripherally surrounding the reformed shoulder, and thus constituting an internal annular skirt peripherally of a reduced diameter region of the bore.

A problem with the known method of making the body is that, in deforming material of the shoulder twice, that is, first towards the head, and then away from the head, the twice deformed material becomes work-hardened to a degree such that not only is it more resistant to such further deformation as will be necessary to form a lock between the body and stem of a fastener when the fastener is set, but there is also a risk that, on such further deformation, the material may become so embrittled as to break off, or become unable to resist forces which tend to displace the plug from the body of the fastener.

We have now devised a method whereby a tubular body may be formed with a deformable internal skirt in which the skirt is formed in a single pass, thereby minimising the work-hardening of the material which forms the skirt.

According to the present invention there is provided a method of making a tubular body having a deformable internal skirt from a blank having a head end and a tail end, and a stopped bore extending from the tail end towards the head end and terminating at an end wall adjacent to the head end of the blank, the method comprising the steps of removing material from the end wall to form a through bore of which a main region is provided by the formerly stopped bore, and a region formed by the step of removing material has a diameter which is reduced as compared with the diameter of the main region, the region of reduced diameter defining a stop shoulder peripherally of the reduced region, and the stop shoulder presenting a stop face which faces into the main region and towards the tail end, characterised in that the step of removing material from the end wall, whereby the region of reduced diameter is formed, is performed so as to form a tapering aperture through the end wall and without deforming the material of the stop shoulder located peripherally of the region of reduced diameter, thereby providing the reduced region of the bore with a diameter which increases progressively towards the head end from a minor diameter adjacent to the main region to a diameter greater than the minor diameter, the minor diameter being reduced as compared with the diameter of the main region so as to provide the stop shoulder, and then swaging material of the stop shoulder in a direction axially away from the head end and radially outwardly into the main region of the bore, and thereby moving the swaged material into the main region of the bore, and forming the swaged material into an annular skirt which is radially separated from material of the body peripherally surrounding the swaged material.

Thus, it will be appreciated that the material of the shoulder which is moved to form the skirt is moved once only, when swaged from peripherally of the region of reduced diameter. It will also be appreciated that the swaging of the shoulder material from peripherally of the region of reduced diameter enlarges the diameter of at least that part of that region having a minimum diameter, but the swaging is also so performed as to leave the region of reduced diameter with a diameter which is smaller than that of the main region of the bore.

It is important that the step of removing material from the end wall to form the tapering aperture be performed without appreciably work-hardening the material which remains peripherally of the aperture. Although it is possible to achieve the necessary removal of material by cutting the end wall, by for example, drilling and reaming, or turning, we prefer to perform this step by piercing out the end wall. We find piercing to be quicker and more efficient than cutting.

Embodiments of the invention will now be described, by way of example, with reference to the accompanying diagrammatic drawings, which are elevations, mainly in section, and in which.

Figure 1:
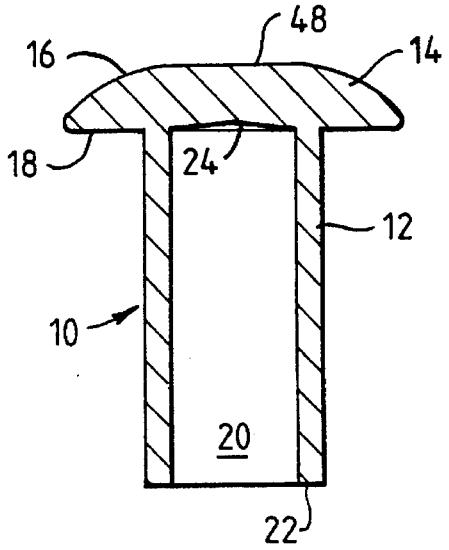
FIG. 1 shows a blank from which a body having a deformable internal skirt may be made.

Referring first to FIG. 1 of the drawings, a blank 10, from which a body having a deformable internal skirt may be made, is formed of a suitably strong, ductile, metal, such as low carbon steel, or aluminium alloy, and comprises a generally cylindrical shank 12 and a radially enlarged head 14 at one end of the shank. The head 14 is of the "round head" kind, having a generally rounded upper surface 16 remote from the shank 12, and a substantially flat underhead surface 18. A cylindrical bore 20 extends axially through the shank from the end, indicated by the reference numeral 22, which is remote from the head 14 and which is hereinafter referred to as the "tail end". The bore 20 is a stopped bore, being terminated, or stopped, by an end wall 24 aligned with the underhead surface 18 and generally forming part of the head 14.

The blank 10 may be formed in any suitable manner, such as, for example, cold forging a cut length of wire stock, as is well known in the art. Thus for example, the blank may conveniently be made in a cold forging machine which then may conveniently be used for carrying out the method of the invention.

The first essential step in the method is to pierce the end wall 24 of the blank. This may be achieved by the use of tooling comprising a punch and a die.

Figure 2:
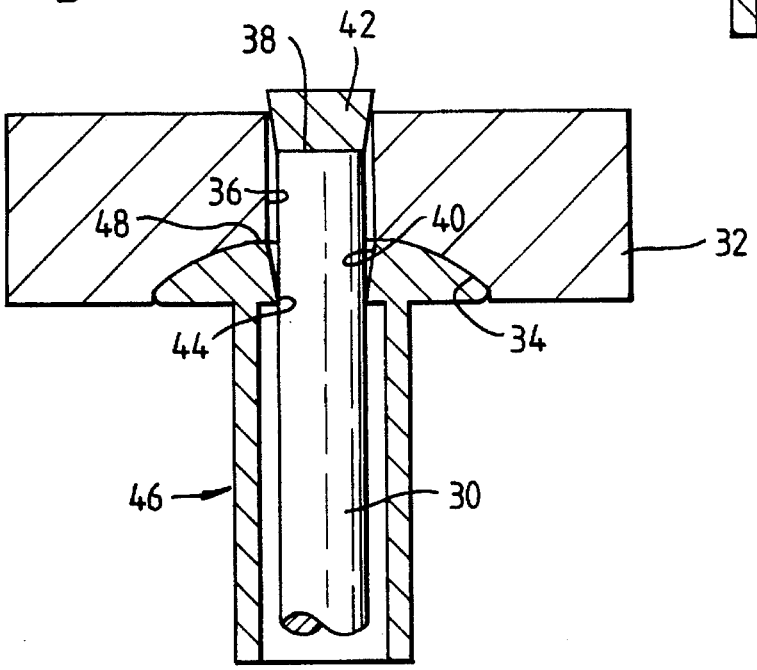
FIG. 2 shows tooling, whereby a first step in one embodiment of the invention may be performed, together with the blank of FIG. 1 on completion of the first step.

Thus, referring to FIG. 2, there is shown a cylindrical punch 30 and a die 32 which together form tooling for piercing the end wall, and which are mounted in a cold forging machine (not shown) for reciprocation relative to each other, in a well known manner.

The die 32 has a recess 34 of rounded shape complementary to the upper surface 16 of the head of the blank 10 so as to act as a support for the head of the blank during a piercing operation. An aperture 36 extends through the die from the center of the recess.

The aperture 36 of the die has a diameter significantly greater than the diameter of the punch 30.

The punch 30 has a working face 38 at right angles to its longitudinal axis, and is axially aligned with the axis of the aperture 36 of the die. The diameter of the punch is appreciably smaller than the diameter of the bore 20 of the blank 10.

In the first step of the method, the upper surface of the head of the blank is supported by the recess of the die so that the bore of the blank is axially aligned with the aperture 36. The punch 30 is then relatively moved towards the die so as to enter the aperture 36 of the die, and, in doing so, pierces through the end wall 24 of the blank, forming an aperture 40 by punching out a slug 42 of waste material, and thus producing a pierced blank 46 as shown in FIG. 2.

Thus, the blank now has a through bore, of which the formerly stopped bore 20 is now the main region, and the pierced aperture 40 provides a reduced region having a diameter smaller than that of the main region, so that there is provided a shoulder 44 of material peripherally of the aperture 40 and which faces axially into the main region 20 and towards the tail end 22.

The pierced aperture 40 has a frusto-conical shape, complementary to the shape of the waste slug 42, and a diameter which increases towards the head end of the pierced blank, which end is indicated by the reference numeral 48.

Thus, the aperture 40 has a minor diameter the same as that of the punch 30 adjacent to the main region 20, and, at the head end 48 of the blank, a greater diameter which is substantially the same as that of the die aperture 36.

It will, of course, be understood that the action of the punch, in cooperation with the die, is to apply a shearing stress to the end wall of the blank in a region which extends from the periphery of the working face 38 of the punch to the periphery of the die aperture 36 which, as previously mentioned, has a diameter greater than that of the working face 38. Thus, the waste slug 42 punched out is of frusto-conical shape and the aperture pierced also has a frusto-conical shape.

The second essential step in the method, which is performed after the piercing of the end wall 24, is to swage material from peripherally of the pierced aperture 40, and to move the swaged material axially away from the head end and into the main region of the bore, and also to move the swaged material radially outwardly in the main region so that it lines the wall of the main region and there forms an annular skirt.

This second step is greatly facilitated by the tapered shape of the reduced region of the through bore and the presence of a volume of material, in the form of the shoulder 44, which intrudes into the reduced region increasingly towards the tail end.

The second, or swaging step may be achieved by the use of tooling comprising a swaging punch, or drift, and a bolster.

Figure 3:
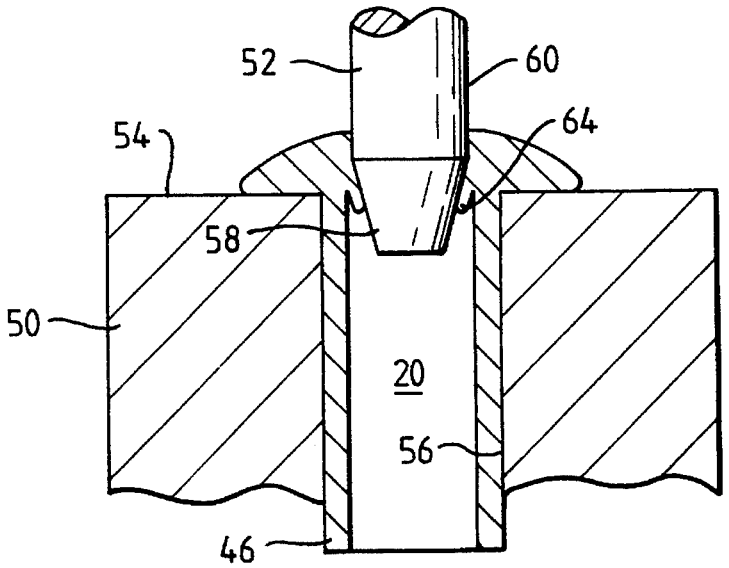
FIG. 3 shows tooling for performing a second step in the method, together with a blank at an intermediate stage in the second step in the method.

Thus, referring now to FIG. 3 there is shown a bolster 50 and a swaging drift 52 which may be mounted in a cold forging machine for reciprocation relative to each other.

The bolster 50 has a flat upper surface 54 adapted to support the underhead surface 18 of the pierced blank 46, and an aperture 56 for receiving the shank 12 of the blank 46 in peripherally supporting engagement.

The swaging drift 52 has a tapered nose 58, and a cylindrical shank 60, and is aligned axially with the aperture 56 of the bolster so as to be able to enter the through bore of a pierced blank 46 supported in the bolster.

Thus, as shown in FIG. 3, the drift 52 is forced to enter the head end of the bore of a pierced blank 46, and thus begins to swage material of the shoulder 44 downwardly into the main region of the bore, forming a depending annular bead 64.

Figure 4:
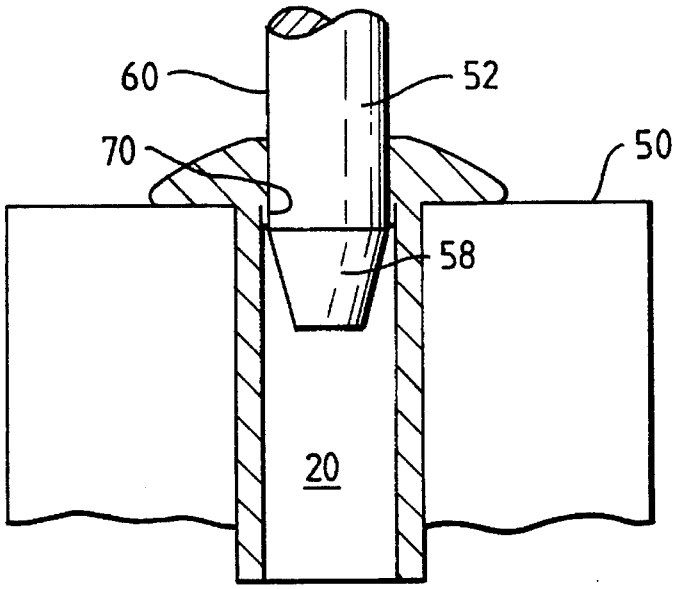
FIG. 4 is a view similar to FIG. 3 showing the blank, and the tooling, on completion of the second step.

As the drift progresses further into the bore, the tapered nose 58 of the drift moves the depending bead 64 radially outwardly into engagement with the peripherally surrounding wall of the main region, as shown in FIG. 4.

Figure 5:
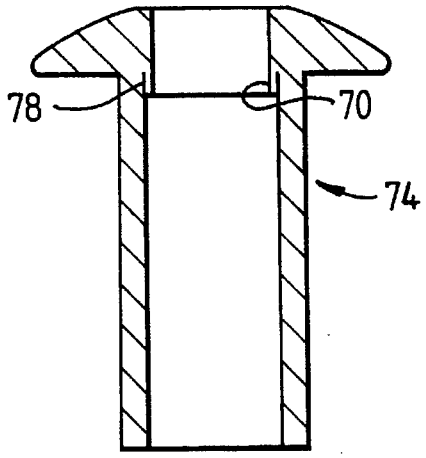
FIG. 5 shows a finished body formed from the blank of FIG. 1 after removal of the tooling.

Thus, material of the shoulder which previously intruded into the reduced region of the bore is swaged into the main region, leaving the reduced region with a constant diameter through at least a substantial part of its length, and the swaged material is moved radially outwardly into contact with the internal surface of the shank and thereby formed into an annular skirt 70 which lines the wall of a part of the main region adjacent to the reduced region. The skirt is radially separated from the peripherally surrounding material of the shank 12. The pierced and swaged blank now constitutes a body for a fastener, as shown in FIG. 5 and indicated by the reference 74.

The forward end of the tapered nose 58 has a diameter such as to be able to enter the minor diameter part of the reduced region of the bore of the pierced blank 46 without deforming the blank 46, but the diameter of the nose increases through an angle which is suitable to progressively engage and swage an increasing amount of material forming the shoulder 44 of the blank 46.

We have found that a suitable half-angle of taper for the nose is usually from 10° to 15°. This angle is critical, however, in order that a suitable balance may be maintained between the tendency of the drift to move material forwardly and the tendency to move it radially outwardly.

The most suitable angle will depend on a number of factors, among which are the taper angle of the reduced region of the bore of the blank, and the volume of material which it is intended should be either dispersed radially into the head 14 or swaged forwardly to form a bead within the main region.

The diameter of the shank 60, of course, determines the final diameter which the reduced region of the bore will have after the swaging operation. It will also be appreciated that the diameter of the shank 60 of the drift must necessarily be smaller than that of the main region of the bore, and that the difference between these two diameters will determine the radial thickness of the skirt to be formed by the swaging operation.

Referring now to FIG. 5, the body 74 formed by the foregoing embodiment has a symmetrical skirt 70 which presents a substantially planar face 76 lying at right angles to the axis of the bore. The radial discontinuity between the skirt and the peripherally surrounding material of the shank is indicated by the reference 78, and is generally referred to as a "cleavage", although it is not produced by cleaving, or cutting, the skirt away from the surrounding material. By virtue of the swaging drift having swaged the whole length of the formerly tapered region 40 of reduced diameter, this region now has a uniform diameter, smaller than that of the main region 20, throughout its length.

In some circumstances, it is desirable that the body should have a skirt which is asymmetrical, in the sense only that its planar face should lie at an angle somewhat less than 90° to the axis of the bore. Such a body can be made, in accordance with the invention either by using a blank of a particular form intended for the purpose, or by using a special arrangement of tooling, as will now be explained.

Figure 6:
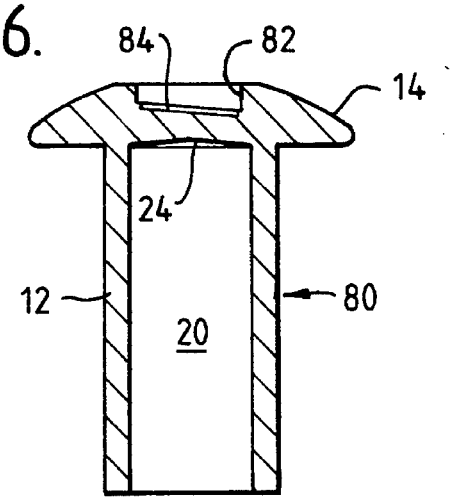
FIG. 6 is a longitudinal sectional elevation of another form of blank which may be used in the method of the invention.

Referring now to FIG. 6, there is shown a blank 80 having parts which are generally similar to those of the blank 10, and which are indicated by the same reference numerals, but the blank 80 has a recess 82 formed in the upper surface 50 of the head. The recess 82 is in the form of a short stopped bore, coaxial with the bore 20, and having a diameter a little smaller than that of the stopped bore 20 in the shank 12. An important feature of the blank 80 is that the recess has a floor 84 which is inclined to the longitudinal axis of the recess and the bore 20, while the end wall 24 which closes the bore 20 lies at right angles to the axis. Thus, as can be seen in FIG. 6, there is a greater thickness of material between the bore 20 and the recess 82 on one side of the blank than on the diametrically opposite side.

Figure 7:
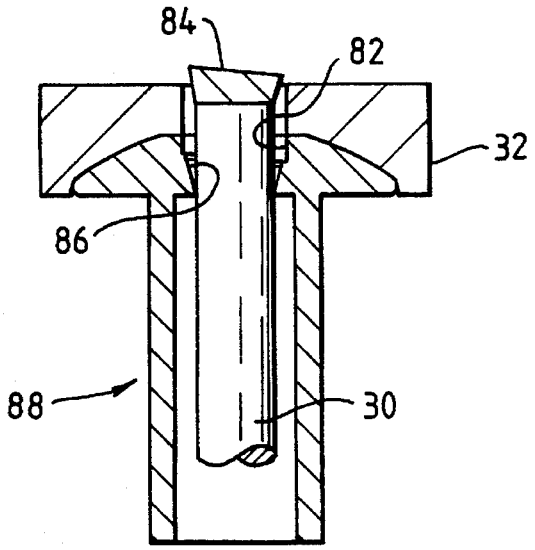
FIGS. 7 to 10 illustrate another embodiment of the invention and show successive stages in the making of a tubular body having an internal skirt using the blank of FIG. 6.

In this embodiment, the blank 80 is pierced in exactly the same way as was the blank 10, using a similar die and punch to pierce through the end wall 24 and into the recess, forming a tapered aperture 86 between the bore 20 and the recess 82 and thereby forming a pierced blank 88. However, in this embodiment the aperture 86 is asymmetrical, as can be seen in FIG. 7. Thus, the aperture 86 has a greater length and gentler taper on one side (the left as seen in FIG. 7) than on the diametrically opposite side. This effect is a consequence of the difference in thickness, on diametrically opposite sides of the blank of the material pierced.

Figure 8:
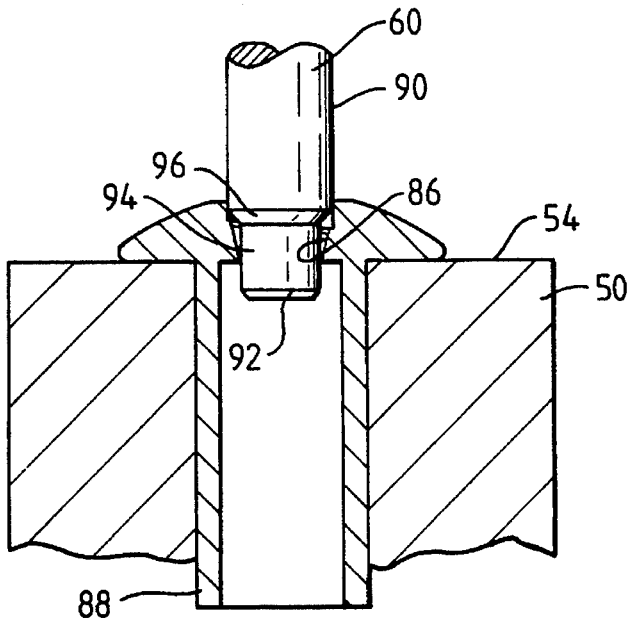

In performing the second step of the method on the pierced blank 88, the bolster 50 and swaging drift 52 previously described may be used, but we prefer to use the bolster 50 with a modified swaging drift 90 as shown in FIG. 8.

Thus, the drift 90 has a short bevelled lead-in 92 followed by a cylindrical portion 94, and then a short tapered portion 96 leads to the cylindrical shank 60 of the drift.

The cylindrical portion 94 has a diameter such as to be able to pass through the aperture 86 while causing minimal enlargement of the aperture, or as a close fit so as to center the punch relative to the aperture. The diameter of the drift is then increased through the tapered portion 96 to a maximum (which maximum generally corresponds to the maximum diameter of the tapered aperture 86 of the pierced blank 88) where the portion 96 joins the shank 60 of the drift 90.

Figure 9:
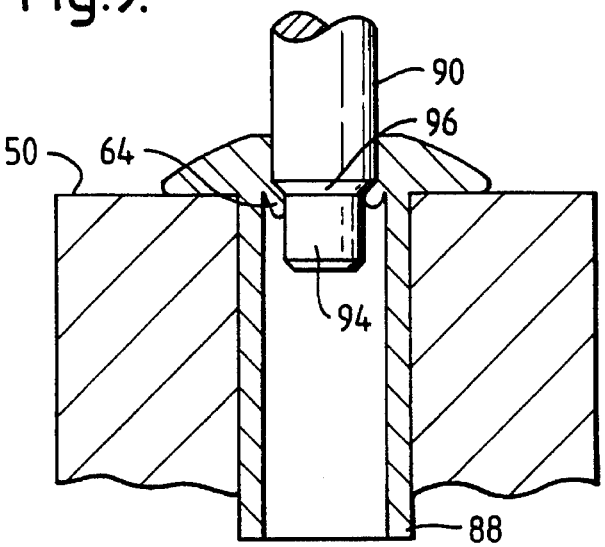
Figure 10:
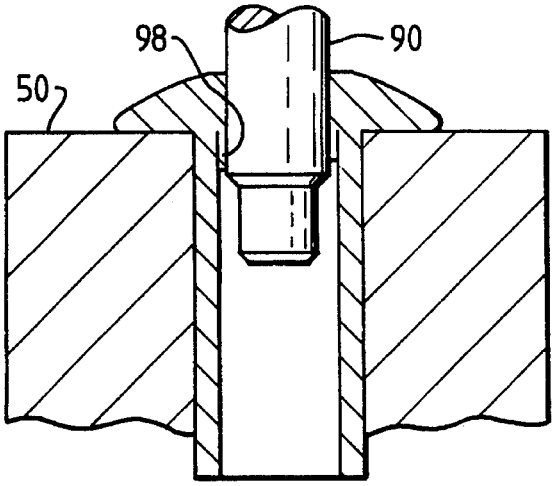
Figure 11:
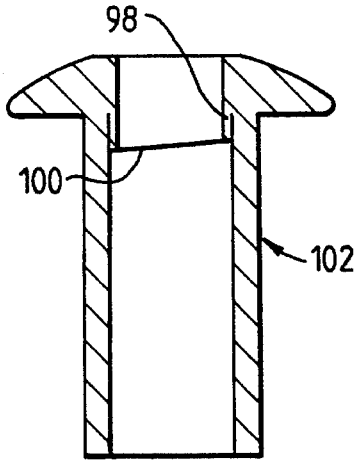
FIG. 11 shows a tubular body having a internal skirt made from the blank of FIG. 6.

The drift 90 is used in a similar manner to that of the drift 52 to swage material from the smaller diameter part of the asymmetrical tapered aperture 86, so as to move the material into the main region and then radially outwardly into engagement with the wall of the main region of the bore 20 to form a skirt 98, the successive stages of which are shown in FIGS. 8 to 10. There is thus produced a body 102 as shown in FIG. 11.

The lead-in 92 facilitates entry of the cylindrical portion through the smallest diameter of the aperture 86, and the tapered portion 96 serves to swage out the tapered bore to a constant diameter in a manner similar to that of the previous embodiment.

Due to the asymmetrical shape of the tapered aperture, and the fact that there is a greater volume of material to be swaged on one side of the aperture than on the diametrically opposite side, the annular skirt 98 formed by swaging and radially expanding the material contains a greater volume of material on the one side than on the opposite side. However, as the drift 90 is aligned axially with the bore of the blank, the thickness of the annular skirt 98 is the same on any radius, and consequently the skirt is longer on those radii where there is more material available. As a result, the skirt 98 presents a substantially planar face 100 which lies at an angle of slope to the plane at right angles to the axis as shown in FIG. 11.

It will be appreciated that the slope angle of the planar face 100 is related to, and dependent on, the slope angle of the floor 84 of the recess 82 of the original blank 80, and the angles can be varied.

In a third embodiment of the invention, a body having an asymmetrical skirt is produced using a blank 10 as previously described and shown in FIG. 1.

Figure 12:
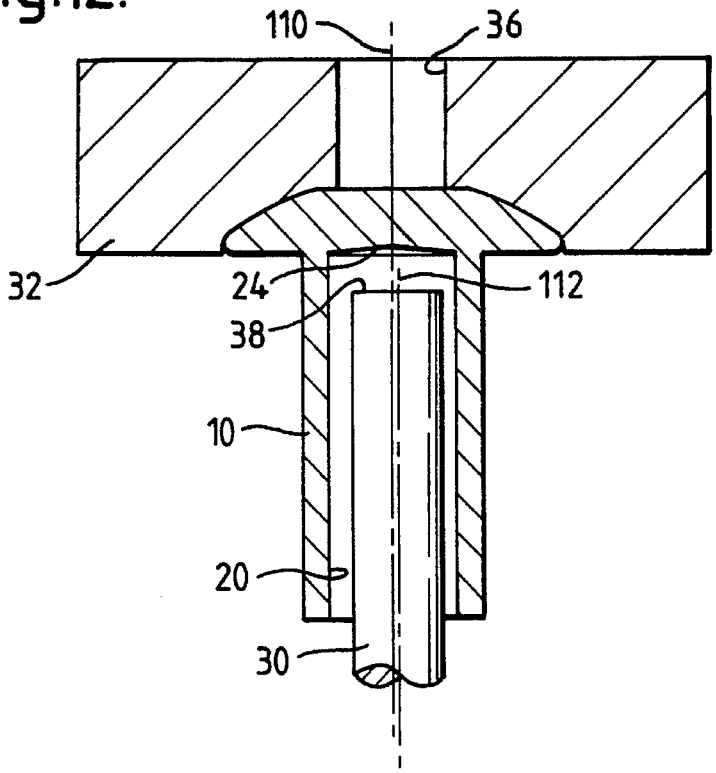
FIG. 12 shows the blank of FIG. 1 together with tooling arranged to perform the first step of a third embodiment of the method of the invention.

In this embodiment, the blank 10 is pierced using the punch 30 and the die 32 previously described. The die is arranged with its axis aligned with the axis of the bore of the blank, these axes being indicated in FIG. 12 by the reference 110. The punch is arranged with its axis, indicated by the reference 112, parallel to, but offset from, the axis 110 of the bore.

Figure 13:
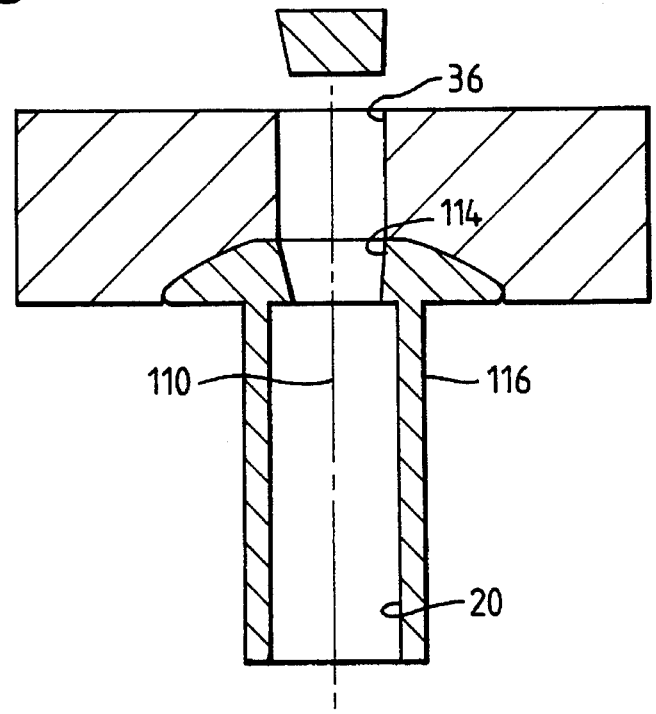
FIG. 13 shows the blank on completion of the first step using the tooling arrangement of FIG. 12.

On piercing the end wall 24 with the punch thus eccentrically arranged relative to the die aperture 36, an asymmetrical tapering aperture 114 is formed, producing a pierced blank 116 as shown in FIG. 13.

Thus, the aperture 114 has a conical taper, the axis of which is inclined to the axis 110 of the main region of the bore 20, the axis being offset at the end where the main and reduced regions meet and being coincident with the axis 110 at the head end of the blank.

The pierced blank 116 is then swaged using the bolster 50 and the swaging drift 52, as described with reference to FIGS. 3 and 4.

As with the second embodiment, in which an asymmetrical aperture was formed in order to produce an asymmetrical skirt, so in this embodiment also the asymmetrical aperture leads to the formation, on swaging, of a skirt having a planar face which is inclined to the plane at right angles to the axis of the bore 20, and the resulting body is similar to that illustrated in FIG. 11.

The invention is not limited to the details of the foregoing embodiments.

I claim:

1. A method of making a tubular body having a deformable internal skirt, comprising the steps of: providing a blank having a head end and a tail end, and a stopped bore extending from the tail end towards the head end and terminating at an end wall adjacent to the head end of the blank;

removing material from the end wall to form a through bore of which a main region is provided by the formerly stopped bore, and a region formed by the step of removing material has a diameter which is reduced as compared with a diameter of the main region, the region of reduced diameter defining a stop shoulder peripherally of the reduced diameter region, and the stop shoulder presenting a stop face which faces into the main region and towards the tail end, wherein the step of removing material from the end wall, whereby the region of reduced diameter is formed, is performed so as to form a tapering aperture through the end wall and without deforming the material of the stop shoulder located peripherally of the region of reduced diameter, thereby providing the reduced diameter region of the bore with a diameter which increases progressively towards the head end from a minor diameter adjacent to the main region to a diameter greater than the minor diameter, the minor diameter being reduced as compared with the diameter of the main region so as to provide the stop shoulder; and then swaging material of the stop shoulder in a direction axially away from the head end and into the main region of the bore, and moving the swaged material radially outwardly in the main region of the bore, and thereby forming the swaged material radially outwardly in the main region of the bore, and thereby forming the swaged material into an annular skirt which is radially separated from material peripherally surrounding the swaged material.

2. A method according to claim 1, wherein the step of removing material from the end wall comprises piercing through the end wall from within the stopped bore by means of a punch while supporting the head end with a die having an aperture, the punch being relatively moved towards the aperture of the die.

3. A method according to claim 2, wherein the punch is axially aligned with the aperture of the die, thereby piercing a symmetrical aperture.

4. A method according to claim 2, wherein the punch is axially offset from axes of the bore and the aperture of the die, thereby piercing an asymmetrical aperture.

5. A method according to any one of claims 2 to 4, wherein the punch has a working face having a diameter smaller than a diameter of the aperture.

6. A method according to any of claims 1 to 4, wherein the material of the shoulder is swaged by means of a swaging drift having a tapered portion for moving the material axially into the main region and in a radially outward direction.

7. A method according to claim 6, wherein the swaged material is moved radially outwardly into engagement with material peripherally surrounding the main region.

8. A method according to claim 1, wherein the swaged material is moved radially outwardly into engagement with material peripherally surrounding the main region.

* * * * *